US005921601A

United States Patent [19]

Buckles

[11] Patent Number: 5,921,601

[45] Date of Patent: Jul. 13, 1999

[54] BAG CLOSURE

[76] Inventor: Kathleen A. Buckles, 5219 2nd Ave. North, Great Falls, Mont. 59405

[21] Appl. No.: 08/863,282

[22] Filed: May 27, 1997

[51] Int. Cl.[6] ..... A45C 13/22; B65D 33/06

[52] U.S. Cl. ..... 294/142; 24/30.5 R; 294/137; 294/165; 383/13; 383/30; 383/68

[58] Field of Search ..... 294/137, 141–143, 294/145, 148, 158, 164–167, 169; 16/114 R; 24/30.5 R, 30.5 S; 223/91, 96, 88; 383/6, 13, 25, 30, 68, 89–91

[56] References Cited

U.S. PATENT DOCUMENTS

| | | | |
|---|---|---|---|
| D. 148,407 | 1/1948 | Cleary | 223/88 X |
| 641,340 | 1/1900 | Smith . | |
| 1,079,527 | 11/1913 | Wallace . | |
| 2,407,841 | 9/1946 | Roy | 223/96 |
| 2,900,118 | 8/1959 | Simon | 223/96 |
| 3,550,838 | 12/1970 | Hart | 383/13 |
| 3,603,491 | 9/1971 | Weight | 223/96 |
| 3,937,394 | 2/1976 | Netschert . | |
| 4,040,562 | 8/1977 | Ward et al. . | |
| 4,112,541 | 9/1978 | Tetradis . | |
| 4,159,729 | 7/1979 | Schwartz | 294/142 |
| 4,178,031 | 12/1979 | Achelpohl . | |
| 4,226,458 | 10/1980 | Achelpohl et al. . | |
| 4,414,717 | 11/1983 | Payne | 24/30.5 R X |
| 4,549,760 | 10/1985 | Minenko et al. . | |
| 4,852,927 | 8/1989 | Minenko et al. . | |
| 5,347,671 | 9/1994 | Hunts | 24/30.5 R X |

FOREIGN PATENT DOCUMENTS

| | | | |
|---|---|---|---|
| 2640856 | 6/1990 | France | 294/137 |
| 1652208 | 5/1991 | U.S.S.R. | 294/137 |

*Primary Examiner*—Johnny D. Cherry
*Attorney, Agent, or Firm*—Jerry Johnson

[57] ABSTRACT

The bag closure comprises a first arm, a second arm, and a third arm. The first, second and third arms each include a first and second end. The second arm is disposed intermediate the first and third arms. The first ends of each arm are permanently attached to a groin and extend therefrom into a first position wherein the second ends of each arm are maintained in a spaced apart orientation where the second ends of each arm are not touching each other and are not secured to each other. In this first position, a first open slot separates the first and second arms and a second open slot separates the second and third arms. A ring is utilized to secure the second ends of the first, second, and third arms in a second position where the first and third arms are moved closer in proximity to the second arm and the first and second slots are substantially closed at the second ends of the arms. The portion of a bag wrapped around the second arm is pressed onto the second arm by the securing of the second ends of the first, second and third arms in a second position. The weight of the contents within the bag further secures the bag within the closure when the bag is permitted to hang from the closure by causing the third arm to urge a portion of the bag that extends beyond the second arm after passing around the second arm against another portion of the bag that has not passed around the second arm. The bag closure typically includes a handle integral with the first arm, and additionally may also include a shoulder strap attached to the first and second ends of the first arm.

10 Claims, 3 Drawing Sheets

BAG CLOSURE

BACKGROUND

Bulk goods of all types are often stored in bags. These bulk goods include household items like flour or dry pet food, food stuffs used in large scale food production, livestock feeds, gardening supplies, and industrial or construction materials such as sand or cement. A common problem associated with the storage of bulk goods in sacks and bags is the inability to close and carry the bag once it has been opened.

The user of products stored in bags is typically unable to close the bag securely and as a result the bags are often causes of spills if tipped, or are easily contaminated by insects or other pests due to the poor closure techniques used on the bags. If the bags store foodstuffs such as at a food processing plant, there is a strong necessity to maintain bags in an orderly manner where spillage is unlikely. There is an even stronger necessity to insure that the food stuffs do not become contaminated with pests and are not accidently contaminated during cleaning processes.

Bags used to store household bulk items are subject to similar contamination problems. Keeping pets out of opened pet food bags would be an example of this problem. Ants or other insects also can easily get into food stuffs such as flour that are stored in bags that have been opened and ineffectively closed. There is, of course, a strong necessity to properly seal a bag containing any bulk item that could be accidently ingested by a child.

Construction materials like cement or sand that are shipped in large bags are very difficult to close effectively. These bags often are transported within vehicles once opened and are very subject to spillage problems. Spillage of bulk construction materials often occurs where clean up is difficult. Because of this, bag spills often contribute to work environments that are already unsafe and messy.

Other problems with bags are associated with the difficulty of carrying and storing bags containing bulk materials.

The difficulty in storing bags is derived from the inability of the bags to be closed effectively as well as the inability of the bags to be hung. As was previously mentioned, poor closure of a bag can lead to spillage or contamination. Contamination of bags from chemicals or pests is a problem with bags stored on the floor. In addition to this, the inability of a bag to be properly closed prevents the stacking of bags on their sides once opened.

Should the user of the bags desire to hang the bags for storage purposes there is essentially no easy way that bulk storage bags can be hung from a hook. This inability keeps bags close to the floor where the bags are not only susceptible to contamination, but are also obstacles when cleaning. Storing bags on the floor prohibits the use of floor space for more important uses other than storage.

An additional problem with bulk storage bags is the difficulty in moving these bags. Someone moving a large bag often has to grasp the bag by wrapping the arms around the bag and then lift the bag using the muscles of the back. This type of lifting is a cause of serious back injuries. The process of moving bags is particularly damaging when many bags have to be moved. If the bags are already opened, the difficulty of moving the bags is compounded by the necessity to minimize spillage from the bags.

For the foregoing reasons there is a need for a bag closure that effectively closes bags of all types to prevent spillage or contamination of the contents of the bag. There is also a need for a bag closure that allows bags to be picked up and moved in a safe manner. There is additionally a need for a bag closure that allows bags to be effectively closed to allow stacking of opened bags during storage. There is a further need for a bag closure that permits bags to be hung during storage.

SUMMARY

The bag closure of the present invention satisfies the aforementioned needs.

The bag closure comprises a first arm, a second arm, and a third arm. The first, second and third arms each include a first and second end. The second arm is disposed intermediate the first and third arms. The first ends of each arm are permanently attached to a groin and extend therefrom into a first position wherein the second ends of each arm are maintained in a spaced apart orientation where the second ends of each arm are not touching each other and are not secured to each other. In this first position, a first open slot separates the first and second arms and a second open slot separates the second and third arms. A securing means is utilized to secure the second ends of the first, second, and third arms in a second position where the second end of the arms are secured together. In this second position the first and third arms are moved closer in proximity to the second arm and the first and second slots are substantially closed at the second ends of the arms. The portion of a bag disposed around the second arm is pressed onto the second arm by the securing of the second ends of the first, second and third arms in a second position. The weight of the contents within the bag further secures the bag within the closure when the bag is permitted to hang from the closure by causing the third arm to urge a portion of the bag that extends beyond the second arm after passing around the second arm against another portion of the bag that has not passed around the second arm. The bag closure typically includes a handle integral with the first arm, and additionally may also include a shoulder strap attached to the first and second ends of the first arm.

The first, second, and third arms typically extend from the groin in a non-parallel orientation and radiate therefrom. The securing means typically comprises a ring pivotally mounted on the third arm for selective positioning between a first position where the ring hangs freely from the first arm, and a second position where the ring hooks around the second end of the first arm and is retained thereupon. The first arm additionally includes a recess wherein the ring may be temporarily disposed when the ring has been moved into a second position. The bag closure may additionally comprise arm positioning means disposed proximate to the second ends of the first, second, and third arms. The arm positioning means would typically comprise a projection disposed on the second end of the first and third arms, and wherein the projections extend toward the second arm. The second arm would include corresponding sockets to receive each projection.

A first advantage of the bag closure of the present invention is the ability of the closure to quickly and effectively close bags of all sizes and bags constructed of many types of materials. The bag closure requires a simple folding over of the bag material to create a loop of bag material. The loop is generally created immediately above the portion of the contents of the bag. Once the loop is created, the user can apply the bag closure. The bag closure clamps the bag at two points on the bag by two outside arms that urge the bag against a middle arm intermediate the two outside arms.

Pests would have to progress past these two clamped areas to access the contents of the bag. The bag contents would also be difficult to contaminate by water spray or cleaning compounds used in proximity to bags closed using the bag closure of the present invention. Because of this, foodstuffs used within food processing plants or used domestically would be easily protected form both spillage or contamination. The bag closure would allow the food stuffs to remain in the bags that were used as packaging for the product and allow the foodstuffs to be dispensed therefrom. This feature would minimize the time consuming task of transferring a bulk product to a separate container once the bag is opened.

The bag closure provides similar benefits for construction materials used in cluttered work environments. The bag closure would permit bags of sand, cement, etc. to remain securely closed. Materials often spilled or contaminated by rainwater would be effectively maintained securely within the bags that were originally used to package the products. These materials could easily be dispensed from their original packaging bags.

The bag closure of the present invention additionally offers benefits assisting in the storage of bags that have been opened. The bag closure allows opened bags to be securely closed and to then be stacked if desired. The bag closure prevents the loss of any of the bag's contents through the closed mouth of the bag and insures that the bags will not accidently open and spill their contents.

The bag closure also allows bags to be hung from the closure. As was previously mentioned, the bag includes an integral handle that could be utilized for hanging a bag closed by the closure. The bag closure could also utilize a structure that would accommodate a specific type of hook if desired. The closure also comprises a structure that uses friction to assist in the retention of the bag within the closure. As such, the bag is most secure when the weight of the bag pulls downward on the closure as would be the case when the bag is hung from the closure. The weight of the bag additionally assists in the degree to which the bag is closed. The portion of the bag that is disposed around the second or middle arm of the bag closure would be tightly closed along the edge of the second arm by the weight of the bag pulling downward on the bag and the bag closure. Additionally, the third arm of the bag closure will urge a portion of the bag that extends beyond the second arm after passing around the second arm against another portion of the bag that has not passed around the second arm. The force of the contents pulling downward on the closure maintains the closure in a vertical orientation which accentuates the force in which the third arm urges the overlapped portion of the bag against the remainder of the bag. As such, the bag is tightly closed at two locations on the closure and would be difficult to penetrate by even small pests.

Allowing bags to be stored above ground allows valuable floor space to be utilized for purposes other than storage. Hung bags would be less accessible to pests. Cleaning and other tasks done proximate to stored bags would also be made easier as the bags would not have to be lifted or moved. The ability of bags to be stored by hanging provides benefits to the storage of storing bulk goods in large food processing plants as well as to the storage of goods in household closets.

The manner in which the bag is retained within the closure that allows a bag to be hung by the closure is what allows the bag to be easily carried by the closure, as well. The bag closure includes an integral handle that allows a bag to be easily lifted and carried with one hand. Alternatively, the bag closure can be fitted with a shoulder strap allowing heavy bags to be easily lifted and carried.

Lifting a bag by the handle or through the use of a shoulder strap allows a bag to be lifted by the leg muscles. The user does not need to bend over and attempt to lift a heavy bag with the back muscles. The ease of grasping the bag closure by the handle or the shoulder strap and moving the bag with the closure prevents the user from having to grasp around the circumference of a large bag. The bag closure in this way offers a much safer means to lift and move bags.

Smaller bags could also be carried in bunches by grasping several bag closure handles simultaneously which would be difficult without the handles provided by the bag closure of the present invention. This feature would allow those involved in large scale food production to quickly move ingredients to a desired location.

The retention of bags within the bag closure as well as the degree that the bag is closed within the bag closure insures that the bag's contents would be unlikely to spill while moving the bags with the handle or shoulder strap of the bag closure.

These and other advantages of the present invention will become apparent upon inspection of the accompanying specification, claims and drawings.

DRAWINGS

DESCRIPTION

Figure 1:
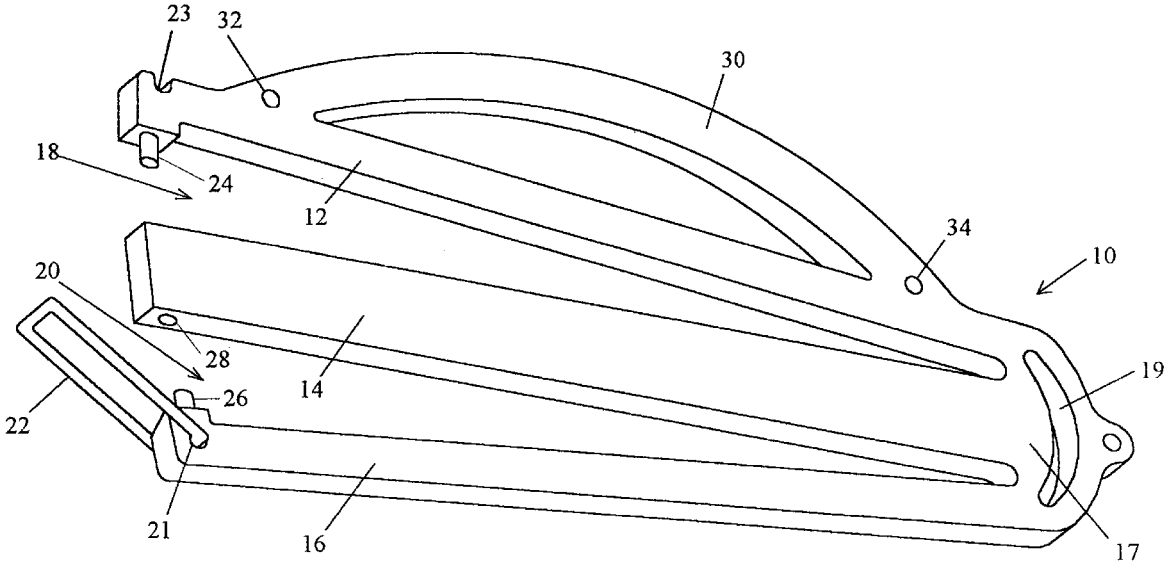
FIG. 1 is a perspective view of a version of the bag closure of the present invention.
Figure 2:
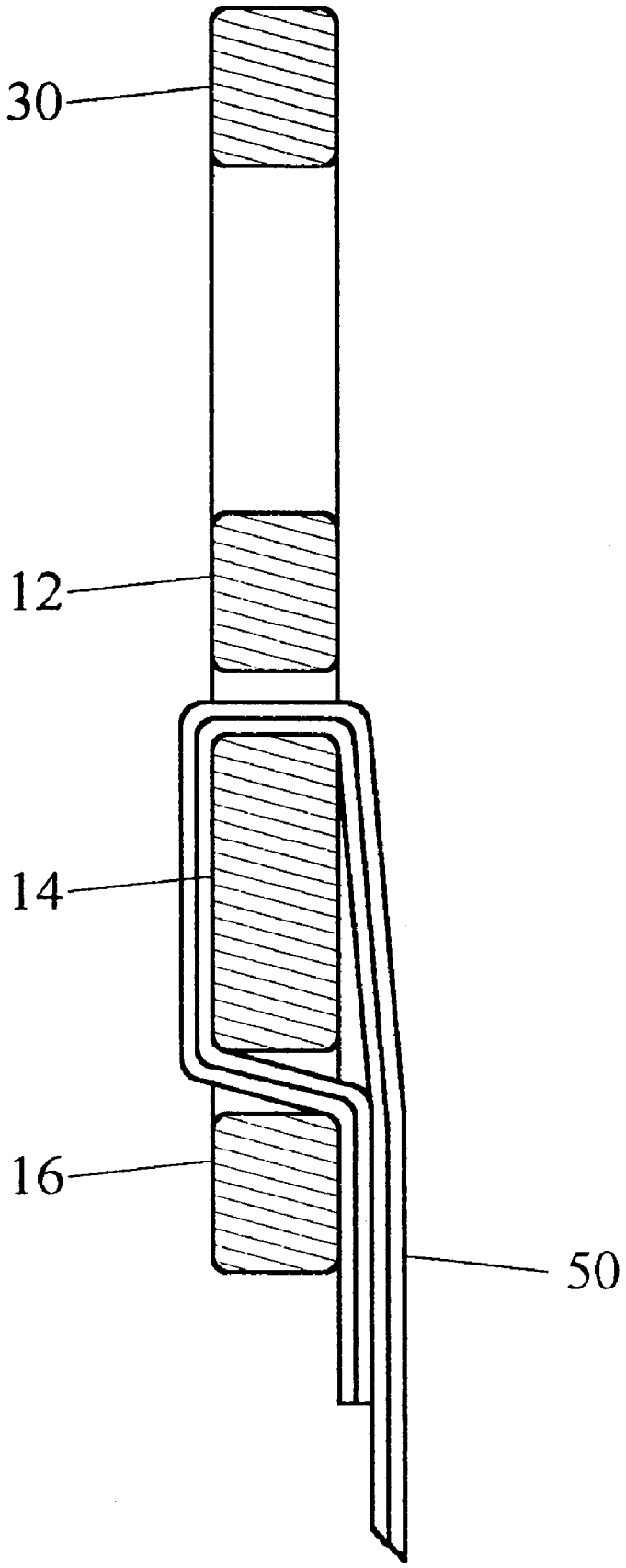
FIG. 2 is a cross-sectional view of the bag closure showing the routing of a bag through the bag closure.
Figure 3:
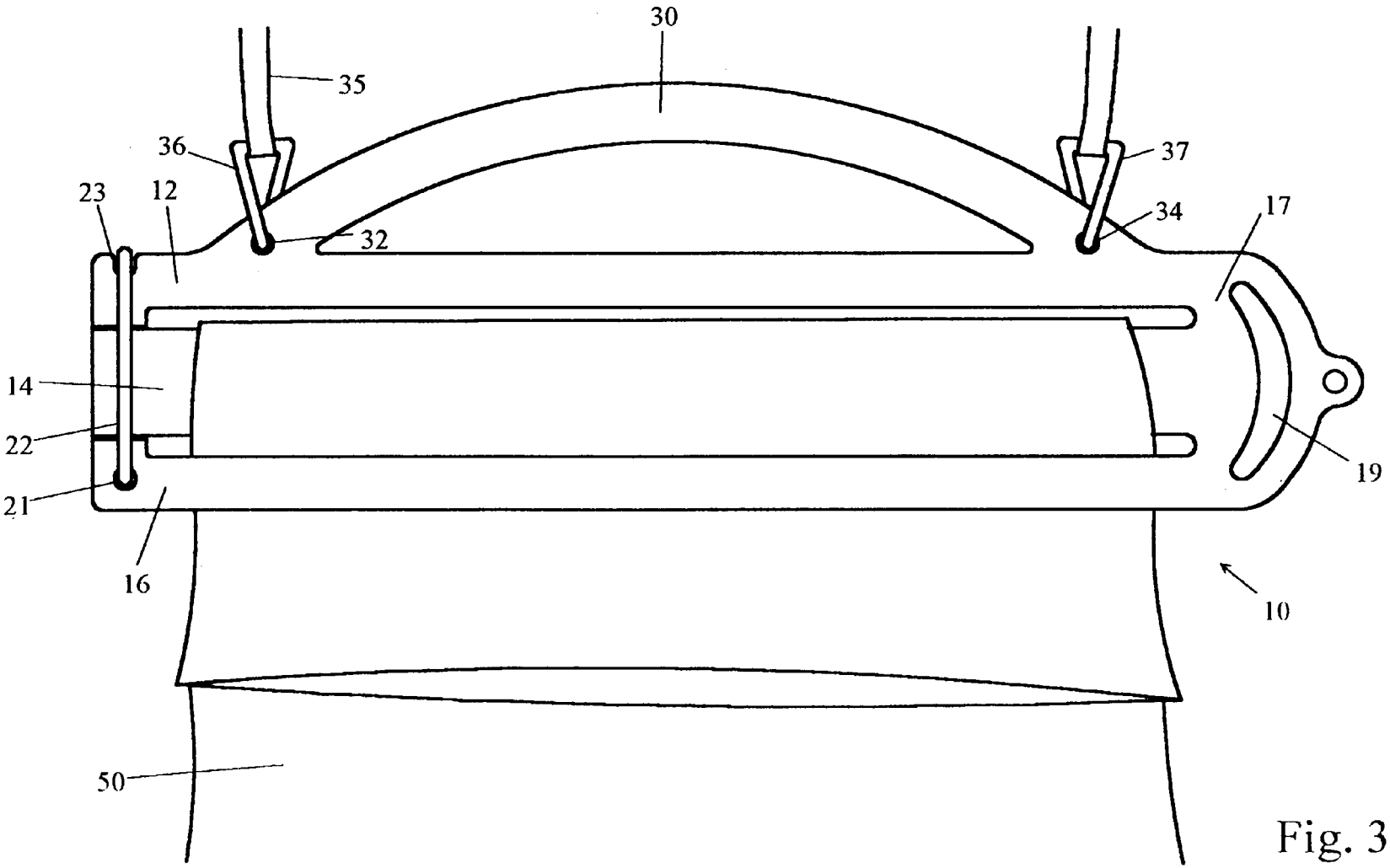
FIG. 3 is a front view of a bag closed by the bag closure and hanging therefrom.

In the drawings, FIG. 1 shows a perspective view of the bag closure 10. The bag closure 10 is shown in an open condition. FIG. 2 shows the bag closure in a cross-sectional side view with a bag 50 shown retained within the closure 10. FIG. 2 also shows the routing of a bag 50 through the bag closure. FIG. 3 is a front view showing a bag 50 closed by the bag closure 10 and hanging therefrom.

In greater detail, FIG. 1 shows the bag closure 10 which includes a first arm 12, a second arm 14, and a third arm 16. Each arm includes a first end that is permanently attached to a groin 17 and a second end opposite the first end. Arms 12, 14, and 16 extend from the groin into a first position shown in this figure where the second end of each arm, distal from the groin, is maintained in a spaced apart orientation and is not touching another arm.

A first open slot 18 separates the first arm 12 and the second arm 14, and a second open slot 20 separates the second arm 14 and the third arm 16. In the first position of the bag closure 10, as is shown in FIG. 1, the slots are open between the second ends of the arms. Additionally, the slots decrease in size going from the opening toward the closed end of the slot that is proximate to the groin 17. The arms 12, 14, and 16, as such, radiate away from the groin 17 while lying substantially within the same plane.

FIG. 1 further shows a ring 22 which comprises a securing means that is utilized to secure the bag closure in a second position (not shown in this figure) where the arms 12, 14, and 16 have been moved together and the slots 18 and 20 are substantially closed. The ring 22 is disposed within a hole 21 through the third arm 16. In this way, the ring 22 is pivotally mounted within the arm 16 for selective positioning between a first position where the ring hangs freely from the third arm (as is shown in this figure), and a second position where the ring hooks around the second end of the first arm 12 and is retained thereupon (shown in FIG. 3). First arm 12 includes a recess 23 within which the ring 22 is retained on first arm 12.

FIG. 1 also shows a first projection 24 disposed on first arm 12, a second projection 26 disposed on the third arm 16, and a hole 28 comprising a socket on the second arm 14. Projections 24 and 26 are disposed proximate to the second end of the arms and extend toward the second arm 14. Projections 24 and 26 comprise arm positioning means and penetrate into socket 28 when the closure is in a second closed position and are retained within the socket 28 preventing the arms 12, 14, and 16 from twisting or flexing outwardly from their original planar orientation.

FIG. 1 further shows a handle 30 disposed on the first arm 12 and typically formed integrally therewith. The handle 30 also includes holes 32 and 34 within which hooks 36 and 37 of shoulder strap 35 can be temporarily disposed (as is shown in FIG. 3).

FIG. 2 shows a cross-sectional view of the bag closure showing how a bag 50 is routed through the closure. FIG. 2 shows a portion of a bag first passing through the first slot separating first arm 12 and second arm 14, then wrapping around the second arm 14, passing through the second slot, and finally being urged by third arm 16 back onto itself in an overlapping orientation.

FIG. 3 shows a front view of a bag 50 closed by the bag closure 10 and hanging therefrom. The bag is shown disposed around the second arm 14 and passes behind the third arm 16 where the bag overlaps onto itself and extends downward in the same direction as the remainder of the bag.

The three arms 12, 14, and 16 are shown in a second or closed position where the first and third arms have been moved into closer proximity to the second arm 14. The ring 22 has been moved to a second position where it hooks around the second end of the first arm 12 and is retained thereupon within the recess 23.

FIG. 3 also shows the bag 50 hanging from the bag closure 10 which itself is hanging from the shoulder strap 35. Shoulder strap 35 typically attaches to the bag closure 10 by hooks 36 and 37. Hooks 36 and 37 are shown within holes 32 and 34 which are shown disposed at opposite ends of the handle 30.

The bag closure 10 of the present invention is simple and effective in use. Closing a bag with the bag closure 10 involves a short process which typically begins with folding the bag material of an opened bag over onto itself so that a loop of material is created which includes a passage within the loop. The bag is folded immediately above the contents of the bag. The mouth of the bag as well as the bag material above the fold overlaps the remainder of the bag in the creation of this loop.

The user then positions the bag closure in a horizontal position with the handle facing away from the portion of the bag that has been folded over. The second arm 14 of the bag closure is then inserted into the passage formed within the loop of bag material. The second arm 14 is typically inserted into this passage while the bag closure is maintained in the horizontal position. As arm 14 progresses into the passage, a portion of the loop of bag material passes into the first slot 18 separating the first arm 12 and the second arm 14 while at the same time another portion of the loop of bag material passes into the second slot 20 that separates the second arm 14 from the third arm 16. The second end of the second arm is typically passed entirely through the passage formed within the loop of bag material until the bag 50 is centered within the bag closure 10.

At this point, the first arm 12 and third arm 16 are flexed toward the second arm 14. To assist that arms 12 and 16 flex at the groin 17, and not along their length, a hole 19 may be included adjacent the groin 17. The arms 12 and 16 are moved from a first position where the arms 12 and 16 extend away from the second arm 14, to a second position where the arms 12 and 16 are moved into close proximity with the second arm 14. As this occurs, the first slot 18 and second slot 20 close onto the bag as is best shown in FIG. 2. Simultaneously, the projections 24 and 26 extend into socket 28. The ring 22 is now pivoted from a first position hanging freely about the third arm 16 to a second position where the ring 22 hooks around the first arm and is retained within the recess 23. The arms 12 and 16 can now be allowed to flex slightly away from the middle arm 14. The outward flexing of the arms 12 and 16 retains the ring 22 securely within the recess 23.

Once the bag closure has been rotated to a vertical position as is shown in FIGS. 2 and 3, the bag is securely closed by the closure with little risk that the contents of the bag could spill out of the bag or that pests could contaminate the contents of the bag. Although the bag closure is most secure when the closure is maintained in a vertical orientation, the bag closure will provide effective closing of bags when the closure is in other positions, as well. Bags utilizing the closure to securely close the bag once opened could easily be stacked in the same manner that unopened bags are stacked.

The bag closure also allows bags to be hung from the closure. As was previously mentioned, the bag includes an integral handle that could be utilized for hanging a bag closed by the closure. The bag closure could also comprise a structure that would accommodate a specific type of hook if desired. The closure also utilizes a structure that uses friction to assist in the retention of the bag within the closure. As such, the bag is most secure when the weight of the bag pulls downward on the closure as would be the case when the bag hangs from the closure.

The weight of the bag additionally assists in the degree to which the bag is closed. The portion of the bag that is disposed around the second or middle arm of the bag closure would be tightly closed along the edge of the second arm by the weight of the bag pulling downward on the bag and the bag closure. Additionally, the third arm of the bag closure will be urged tightly against the portion of the bag that overlaps back on to the remainder of the bag. This is best shown in FIG. 2.

The force of the contents pulling downward on the closure maintains the closure in a vertical orientation which accentuates the force in which the third arm urges the overlapped portion of the bag against the remainder of the bag. As such, the bag is tightly closed at two locations on the closure and would be impenetrable by even small pests. It is understood that the closure could be manufactured to accommodate different bag materials and bag material thicknesses. In this way, the degree of clamping offered by first and third arms could be customized for a particular application.

Allowing bags to be stored above ground allows valuable floor space to be utilized for purposes other than storage. Cleaning and other tasks done proximate to stored bags would also be made easier as the bags would not have to be lifted or moved. The ability of bags to be stored by hanging provides benefits to the storage of bulk goods in any situation.

The manner in which the bag is retained within the closure that allows a bag to be hung by the closure is what allows the bag to be easily carried by the closure, as well. The bag closure includes an integral handle that allows a bag to be easily lifted and carried with one hand. Alternatively, the bag closure can be fitted with a shoulder strap allowing heavy bags to be easily lifted and carried.

Lifting a bag by the handle or through the use of a shoulder strap allows a bag to be lifted by the leg muscles. The user does not need to bend over and attempt to lift a heavy bag with the back muscles. The ease of grasping the bag closure by the handle or the shoulder strap and moving the bag with the closure prevents the user from having to grasp around the circumference of a large bag. The bag closure in this way offers a much safer means to lift and move bags. Smaller bags could also be carried in bunches by grasping several bag closure handles simultaneously which would be difficult without the handles provided by the bag closure of the present invention.

The retention of bags within the bag closure as well as the degree that the bag is closed within the bag closure insures that the contents of the bags would be unlikely to spill while moving the bags with the handle or shoulder strap of the bag closure.

The bag closure of the present invention is easy to use and easy to manufacture using existing low cost manufacturing techniques and low cost materials such as plastics. The bag closure could also be manufactured from metals, a combination of plastic and metal, or any material that provides the necessary strength, flexibility, and durability and is also easy to clean.

Although a preferred version of the present invention has been shown in FIGS. 1 to 3 and described herein, it is understood that various modifications and changes in form or detail could readily be made without departing from the spirit of the invention.

Examples of modifications that could be included within the design of the bag closure include the use of a roughened material to increase the friction imparted on the bag by the closure. Similarly, the cross-sectional profiles of the arms could also be altered for the same effect. The handle could be angled away from the plane of the three arms so as to increase the force that the third arm applies to the bag when a bag hangs from the closure. This orientation of the handle also could increase comfort when carrying a bag by the closure.

Other changes to the design of the closure could include the removal of the arm positioning means or a different interlocking configuration of the second ends of the three arms. The first and third arms also could be manufactured to arch outwardly in a first open position wherein the arms would apply a greater force on the bag as the arms are flexed toward the second arm to be secured in the closed second position. The bag closure could be manufactured in a variety of sizes.

It is therefore intended that the invention be not limited to the exact form and detail herein shown and described, nor to anything less than the whole of the invention herein described and as hereinafter claimed.

I claim:

1. A bag closure comprising:

a first arm, a second arm, and a third arm; wherein the first, second and third arms each include a first and second end; and, wherein the second arm is disposed intermediate the first and third arms;

a groin, wherein the first ends of each arm are attached to the groin and extend therefrom;

wherein the first, second, and third arms extend from the groin into a first position wherein the second ends of each arm are maintained in a spaced apart orientation where the second ends of each arm are not touching each other and are not secured to each other and wherein a first open slot separates the first and second arms and a second open slot separates the second and third arms; and wherein intermediate the first and second ends of the second arm, the second arm includes no elements extending therefrom which would interfere with a placement and securement of a loop of a bag material around the second arm; and wherein the second arm includes no elements extending therefrom which would apply a concentrated force on a loop of a bag material which is placed and secured around the second arm which could penetrate through the bag material; and wherein the second arm having no elements extending therefrom, intermediate the first and second ends of the arm, is adapted for the placement and securement of a loop of bag material around therewith; and securing means for securing the second ends of the first, second, and third arms in a second position where the second ends of the first and third arms are moved closer in proximity to the second arm, and the first and second slots are substantially closed at the second ends of the arms; and whereby a loop of bag material disposed around the second arm is pressed onto the second arm by the securing of the second ends of the first, second and third arms in the second position, and whereby the weight of the bag further secures the bag within the closure when the bag is permitted to hang from the closure; and whereby the third arm urges a portion of the loop of bag material that extends beyond the second arm after passing around the second arm against another portion of the bag that has not passed around the second arm.

2. The bag closure of claim 1, additionally comprising a handle integral with the first arm.

3. The bag closure of claim 1, additionally comprising a shoulder strap attached to the first. and second ends of the first arm.

4. The bag closure of claim 1, wherein the first, second, and third arms extend from the groin in a non-parallel orientation and radiate therefrom.

5. The bag closure of claim 1, wherein the securing means serves to directly secure the first arm to the third arm.

6. The bag closure of claim 1, wherein the securing means comprises a ring.

7. The bag closure of claim 6, wherein the ring is disposed on the third arm for selective positioning between a first position where the ring hangs freely from the third arm, and a second position where the ring hooks around the second end of the first arm and is retained thereupon.

8. The bag closure of claim 7, wherein the first arm additionally includes a recess wherein the ring may be temporarily disposed when the ring has been moved into a second position.

9. The bag closure of claim 1, additionally comprising arm positioning means disposed proximate to the second ends of the first and third arms.

10. The bag closure of claim 9, wherein the arm positioning means comprise a projection disposed on the second ends of the first and third arms, and wherein the projections extend toward the second arm; and wherein the second arm includes corresponding sockets to receive each projection.

* * * * *